US006525457B1

(12) United States Patent
Peen et al.

(10) Patent No.: US 6,525,457 B1
(45) Date of Patent: Feb. 25, 2003

(54) TENSIONED SHADOW MASK ASSEMBLY FOR FLAT CATHODE RAY TUBE

(75) Inventors: Do-hoon Peen, Yongin (KR); Sung-oh Rho, Seocho-gu (KR); Oan Kim, Yongin (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 184 days.

(21) Appl. No.: 09/666,546

(22) Filed: Sep. 21, 2000

(51) Int. Cl.[7] ..... H01J 29/80
(52) U.S. Cl. ..... 313/404; 313/402
(58) Field of Search ..... 313/402, 406, 313/407, 404

(56) References Cited

U.S. PATENT DOCUMENTS 4,605,878 A * 8/1986 Saita et al. ..... 313/406
4,827,178 A * 5/1989 Higashinakagawa et al. .... 313/402
5,672,935 A * 9/1997 Ito et al. ..... 313/406
6,356,010 B1 * 3/2002 Nakamura ..... 313/402

FOREIGN PATENT DOCUMENTS

KR 1992-18664 10/1992
KR 1999-0014720 5/1999

* cited by examiner

*Primary Examiner*—Robert H. Kim
*Assistant Examiner*—Jurie Yun
(74) *Attorney, Agent, or Firm*—Leydig, Voit & Mayer, Ltd.

(57) ABSTRACT

A tension-type shadow mask assembly for a flat cathode ray tube including a planar tension-type shadow mask including numerous slits, first and second parallel spaced apart support members for supporting opposite edges of the shadow mask, first and second rigid members facing each other under the first and second support members and connected at ends to the first and second support members to elastically support the first and second support members, and connectors installed on the first and second rigid members for connection to stud pins of a panel installed on the shadow mask and accommodating the shadow mask.

4 Claims, 3 Drawing Sheets

TENSIONED SHADOW MASK ASSEMBLY FOR FLAT CATHODE RAY TUBE

BACKGROUND OF THE INVENTION

1. Field of the Invention

The present invention relates to a shadow mask assembly, and more particularly, to a tension-type shadow mask assembly for a flat cathode ray tube (CRT) having improved connection of the shadow mask assembly to a panel.

2. Description of the Related Art

Generally, if power is applied to a CRT, an electron gun emits an electron beam from a cathode. The emitted electron beam passes through electron beam apertures of a plurality of electrodes is focused and accelerated. The accelerated electron beam is selectively deflected by a deflection yoke installed on a cone portion of a bulb, and excites a phosphor layer coated on the inner surface of the panel forming a screen. A recent tendency of a color CRT is to make an outer surface of its panel flat in order to widen angle of viewing. Such a flat CRT employs a tension-type shadow mask.

Referring to FIG. 1, a conventional tension-type shadow mask assembly 10 includes a tension-type shadow mask 11, a first support member 12 and a second support member 13 installed, parallel to each other, for fixing the shadow mask 11, and a first rigid member 14 and a second rigid member 15, both ends of which are fixed to the lower parts of the first and second support members 12 and 13, and which are installed facing each other.

A holder 16 is installed at side walls of the first and second support members 12 and 13. An elastic member such as a plate spring 17, is installed in the holder 16. A coupling hole 17*a* is formed in the plate spring 17 for connection to a stud pin (not shown) located inside the panel.

A process for fabricating the tension-type shadow mask assembly 10 will now be described briefly.

First, the first and second support members 12 and 13 are pressed in opposite directions to produce a displacement. Here, the first and second rigid members 14 and 15 fixed in the lower portions of the first and second support members 12 and 13 are elastically deformed so that a compressive force is applied thereto.

Next, the shadow mask 11 is aligned lengthwise with respect to the first and second support members 12 and 13. In such a state, welding is performed, and the compressive force applied to the first and second support members 12 and 13 is released. Accordingly, the tension-type shadow mask 11 is fixed to the first and second support members 12 and 13 in a state in which a predetermined tension is applied thereto.

The thus fabricated shadow mask assembly 10 is installed inside the panel. In other words, the shadow mask assembly 10 is positioned on the panel such that the stud pin inside the panel is inserted through the coupling hole 17*a* of the plate spring 17 installed at side walls of the first and second support members 12 and 13.

In the conventional shadow mask assembly 10, the holder 16 and the plate spring 17 connected thereto are installed at side walls of the first and second support members 12 and 13. Thus, if the distance between the first and second support members 12 and 13 is increased for the purpose of increasing the effective area of a screen on the front surface of the panel, interference between the connection means installed at the side walls of the first and second support members 12 and 13 and the inner surface of the panel may occur.

SUMMARY OF THE INVENTION

To solve the above problem, it is an object of the present invention to provide a tension-type shadow mask assembly for a flat cathode ray tube (CRT) having a connection means installed at a rigid: member for maintaining support members for supporting a shadow mask to be disposed parallel to each other, so as to facilitate connection between the shadow mask assembly and a panel.

Accordingly, to achieve the above object, there is provided a tension-type shadow mask assembly for a flat cathode ray tube including a planar tension-type shadow mask on which numerous slits are formed, first and second support members each installed under the shadow mask in parallel at a predetermined distance, for supporting both edges of the shadow mask, first and second rigid members installed to face each other under first and second support members such that one ends thereof are connected to the first support members and the other ends thereof are connected to the second support members to elastically support the first and second support members, and a plurality of connection means installed in the first and second rigid members so as to be connected to stud pins of a panel installed on the shadow mask for accommodating the shadow mask.

Also, each of the connection means includes a hook having a plane portion which surface-contacts the top plane of the rigid member to be fixed and an extension portion which integrally extends upward from the plane portion, and a spring having a contact portion fixed to the outer surface of the extension portion, a sloping portion which slopes downward at a predetermined angle from the contact portion, and a connection portion bent downward at a predetermined angle from the sloping portion at a predetermined angle and having a connection hole coupled to the stud pin.

Further, each of the connection means may include a hook having a plane portion which surface-contacts the bottom plane of the rigid member to be fixed and an extension portion which integrally extends upward from the plane portion, and a spring having a contact portion fixed to the outer surface of the extension portion, a sloping portion which slopes downward at a predetermined angle from the contact portion, and a connection portion bent downward from the sloping portion and having a connection hole coupled to the stud pin.

Also, a bead portion is preferably formed at the end of the extension portion.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

A tension-type shadow mask assembly according to an embodiment of the present invention will now be described in detail with reference to the accompanying drawings.

Figure 1:
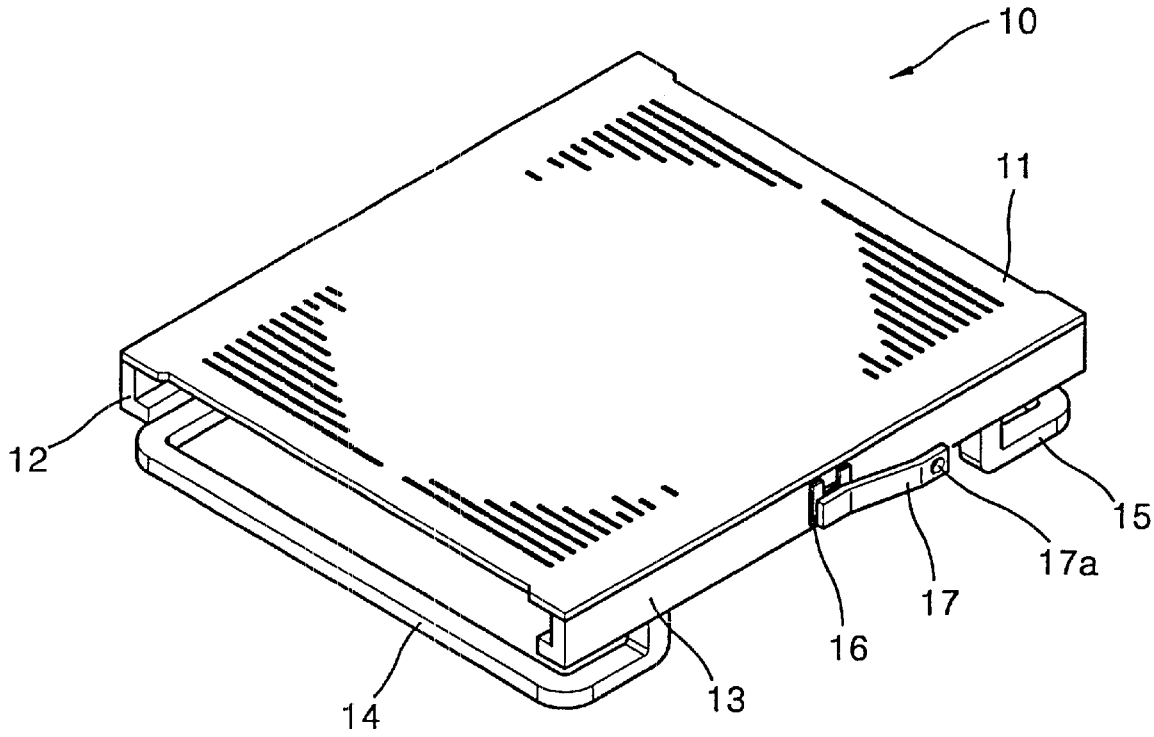
FIG.1 ( PRIOR ART )
FIG. 1 is a perspective view of a conventional tension-type shadow mask assembly.
Figure 2:
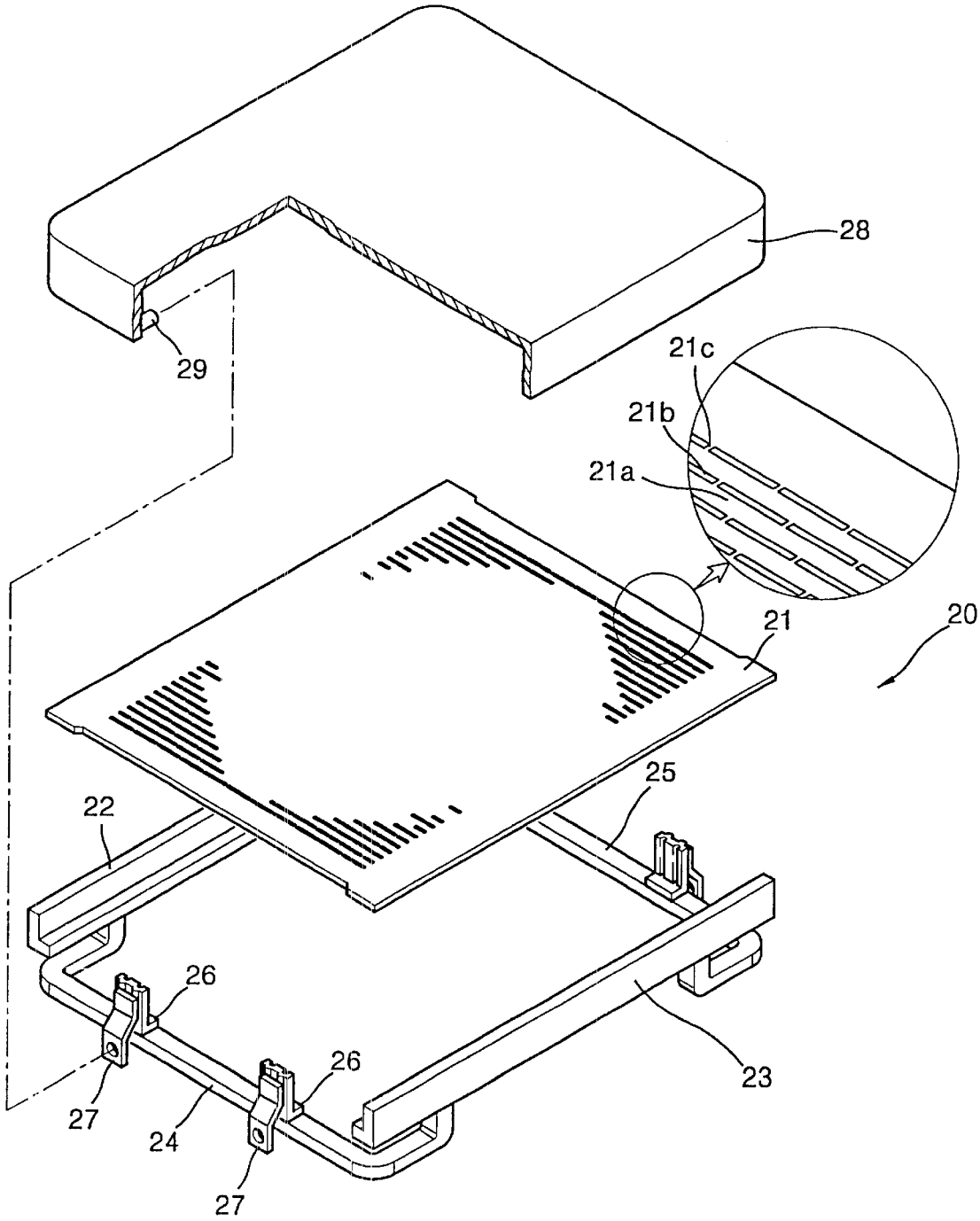
FIG. 2 is an exploded perspective view of a tension-type shadow mask assembly and a panel according to an embodiment of the present invention.

FIG. 2 shows a tension-type shadow mask assembly 20 and a panel 28 according to the present invention.

Referring to FIG. 2, the shadow mask assembly 20 has a function of selecting colors produced by electron beams, and includes a tension-type shadow mask 21 to which tension is applied. The shadow mask 21 includes a plurality of strips 21*a* spaced apart at a predetermined interval, and a plurality of slits 21*b* through which numerous electron beams pass. The slits 21*b* are shaped-of-intermittent strips and are supported by tie bars 21*c*.

Under the shadow mask 21 are installed first and second support members 22 and 23 for supporting the shadow mask 21. The first and second support members 22 and 23 are spaced apart a predetermined distance from each other, are parallel, and their cross-sections are "L" shaped. The first and second support members 22 and 23 each have a mounting plane on which the shadow mask 21 is welded, on their top planes. Opposite edges of the shadow mask 21 are fixed to the mounting plane lengthwise.

On the bottom surfaces of the first and second support members 22 and 23 are installed first and second rigid members 24 and 25 for elastically supporting the first and second support members 22 and 23, respectively. The first and second rigid members 24 and 25 face each other. Also, one end of each of the first and second rigid members 24 and 25 is fixed to the bottom surface of the first support member 22 and the other ends thereof are fixed to the bottom surface of the second support member 23.

The hook 31 includes a planar portion 31*a* which fixedly contacts the top surface of the rigid member 24 and an extension portion 31*b* which integrally extends upward from the plane portion 31*a*. The cross-section of the hook 31 is "L" shaped.

Figure 3:
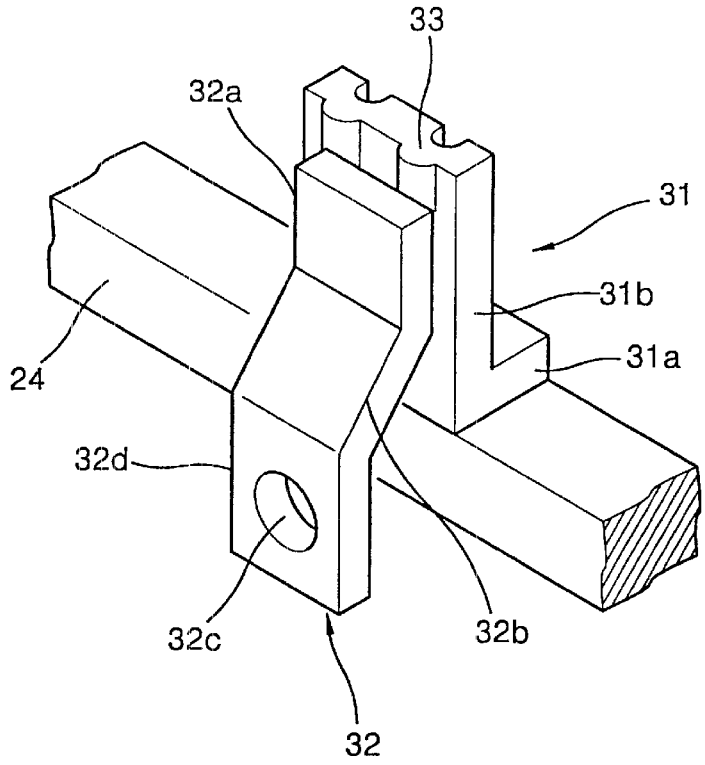
FIG. 3 is an enlarged perspective view of an exemplary connection means shown in FIG. 2.

FIG. 3 illustrates an embodiment of the connection means.

Referring to FIG. 3, a hook 31 is fixed on the top plane of the rigid member 24 installed under the shadow mask (21 of FIG. 2).

The hook 31 includes a planar portion 31*a* which fixedly contacts the top surface of the rigid member 23 and an extension portion 31*b* which integrally extends upward from the planar portion 31*a*. The cross-section of the hook 31 is "L" shaped.

A plate spring 32 coupled to the stud pin 29 shown in FIG. 2 is installed on the rear surface of the extension portion 31*b*. The plate spring 32 includes a contact portion 32*a* which surface-contacts the rear surface of the extension portion 31*b*, a sloping portion 32*b* which extends so as to slope downward from the contact portion 32*a* at a predetermined angle, away from the extension portion 31*b* and a connection portion 32*d* bent downward from the end of the sloping portion 32*b* and having a connection hole 32*c* to be connected with the stud pin 29.

A bead portion 33 is formed at the end of the extension portion 31*b* of the hook 31 for the purpose of reinforcing the structural strength against deformation due to thermal expansion of the shadow mask 21.

Figure 4:
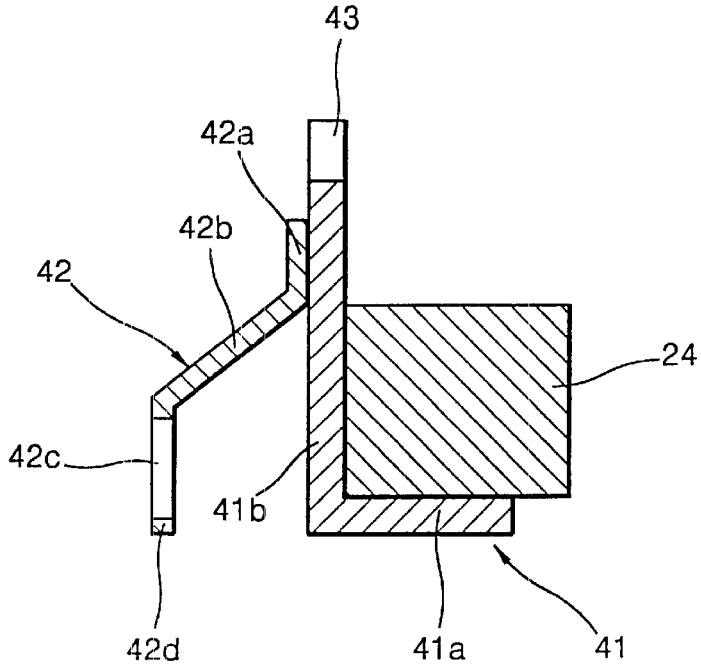
FIG. 4 is an enlarged cross-sectional view of another exemplary connection means shown in FIG. 2.

FIG. 4 illustrates in cross-section connection means according to another embodiment of the present invention.

Referring to FIG. 4, a hook 41 is connected to the outer surface of the rigid member 24. In other words, a planar portion 41*a* surface-contacts the bottom surface of the rigid member 24 installed under the shadow mask (21 of FIG. 2).

An extension portion 41*b* is bent from the planar portion 41*a* surface-contacts the outer surface of the rigid member 24, and extends upward. In this case, the hook 41 is configured to surround the outer surface of the rigid member 24.

A plate spring 42 which is an elastic bias means is fixed to the extension portion 41*b*. A flat-panel contact portion 42*a* surface-contacts the outer surface of the extension portion 41*b*. A sloping portion 42*b* extends downward from the end of the contact portion 42*a* to be sloped at a predetermined angle relative to the extension portion 41*b*. A connection portion 42*d* is bent directly downward from the sloping portion 42*b*. A connection hole 42*c* in the connection portion 42*d* fixedly connects with the stud pin 29.

A process for fabricating the tension-type shadow mask assembly having the aforementioned configuration will now be described with reference to FIG. 2.

First, the first and second support members 22 and 23 are inwardly pressed to produced a displacement. According to the displacement of the first and second support members 22 and 23, the first and second rigid members 24 and 25 for supporting the first and second support members 22 and 23 from the lower parts thereof are elastically deformed by the compressive force.

Then, the planar shadow mask 21 is arranged such that its long sides are positioned on the top planes of the first and second support members 22 and 23, and then welded. Next, the pressure applied to the first and second support members 22 and 23 is released.

If the pressure is released from the first and second support members 22 and 23, the first and second rigid members 24 and 25 are restored to their original positions, but in a compressed state. Accordingly, the tension-type shadow mask 21 is fixed to the first and second support members 22 and 23 under predetermined tension.

Next, the panel 28 is mounted from the upper portion of the shadow mask assembly 20 to accommodate the same. The shadow mask assembly 20 is positioned in a space inside the panel 28 and a plurality of stud pins 29 protruding at side walls of the panel 28 are fixed to the connection means of the rigid members 24 and 25.

In other words, each hook 26 surface-contacts the top or bottom planar surface of the first and second rigid members 24 and 25 and is welded thereto. Each plate spring 27 having an elastic force is connected to the outer surface of a hook 26 and each stud pin 29 is fixed to the connection hole of one of the plate springs 27.

Accordingly, in a state in which predetermined tension is applied to the shadow mask assembly 20 installed in the panel 28, the electron beam emitted to an electron gun passes through the slips 21*b* of the tension-type shadow mask 21 and accurately lands on a fluorescent layer.

As described above, in the tension-type shadow mask assembly for a flat CRT according to the present invention, hooks and springs coupled thereto are installed on a plurality of rigid members installed on of support members for supporting a shadow mask. Therefore, even if the distance between supporting members is increased for the purpose of increasing the effective area of a screen, interference with the connection means connected to the stud pin of the panel can be prevented.

Although the invention has been described with respect to a specific illustrative embodiment, it is not to be construed as limitations and additional modifications and equivalents thereof will readily occur to those skilled in the art from the invention disclosed herein. Therefore, the actual scope of the invention is intended to be defined in the appended claims.

What is claimed is:

1. A tensioned shadow mask assembly for a flat cathode ray tube comprising:

a planar tensioned shadow mask including a plurality of slits;

first and second support members parallel to each other and spaced apart at a distance, for supporting opposite edges of the shadow mask;

first and second rigid members facing each other and having respective first and second ends connected to the first and second support members respectively to elastically support the first and second support members; and a plurality of connection means installed on the first and second rigid members for connection to stud pins of a panel installed on the shadow mask and accommodating the shadow mask, wherein each of the connection means comprises:

a hook having a planar portion which contacts a top planar surface of one of the first and second rigid members and is fixed thereto and an extension which integrally extends transverse to the planar portion; and a spring having a contact portion fixed to an outer surface of the extension, a sloping portion which slopes at a first angle from the contact portion, and a connection portion bent at a second angle from the sloping portion and having a connection hole for coupling to a stud pin.

2. The tensioned shadow mask assembly according to claim 1, wherein the extension includes a bead at an end of the extension.

3. A tensioned shadow mask assembly for a flat cathode ray tube comprising:

a planar tensioned shadow mask including a plurality of slits;

first and second support members parallel to each other and spaced apart at a distance, for supporting opposite edges of the shadow mask;

first and second rigid members facing each other and having respective first and second ends connected to the first and second support members respectively to elastically support the first and second support members; and a plurality of connection means installed on the first and second rigid members for connection to stud pins of a panel installed on the shadow mask and accommodating the shadow mask, wherein each of the connection means comprises:

a hook having a planar portion which contacts a bottom planar surface of one of the first and second rigid members and is fixed thereto and an extension which integrally extends transverse to the planar portion; and a spring having a contact portion fixed to an outer surface of the extension, a sloping portion which slopes at a first angle from the contact portion, and a connection portion bent at a second angle from the sloping portion and having a connection hole for coupling to a stud pin.

4. The tensioned shadow mask assembly according to claim 3, wherein the extension includes a bead at an end of the extension.

* * * * *